United States Patent [19]

Kataoka et al.

[11] Patent Number: 4,985,334

[45] Date of Patent: Jan. 15, 1991

[54] SELF-PROCESSING FILM UNIT

[75] Inventors: Hideaki Kataoka; Kenji Sashihara, both of Kanagawa, Japan

[73] Assignee: Fuji Photo Film Co., Ltd., Kanagawa, Japan

[21] Appl. No.: 499,670

[22] Filed: Mar. 27, 1990

[30] Foreign Application Priority Data

Mar. 27, 1989 [JP] Japan ..... 1-74545

[51] Int. Cl.[5] ..... G03C 3/00; G03D 5/02

[52] U.S. Cl. ..... 430/207; 430/210; 430/496; 430/497; 354/304

[58] Field of Search ..... 430/207, 208, 209, 210, 430/497, 496; 354/304

[56] References Cited

U.S. PATENT DOCUMENTS 4,767,691 8/1988 Betger et al. ..... 430/210

FOREIGN PATENT DOCUMENTS 61-48839 3/1986 Japan .

*Primary Examiner*—Richard L. Schilling

*Attorney, Agent, or Firm*—Young & Thompson

[57] ABSTRACT

A self-processing film unit has an over sheet for covering a surface which is exposed after an image recording sheet with a positive image recorded therein has been peeled off. The over sheet is superimposed on the exposed surface after peeling-off and adheres to the exposed surface to prevent processing liquid remaining on that exposed surface from soiling the hands or clothing of the user.

15 Claims, 4 Drawing Sheets

SELF-PROCESSING FILM UNIT

BACKGROUND OF THE INVENTION

This invention relates to a self-processing film unit for an instant camera, and more particularly to a peel-off self-processing film unit in which an image recording sheet with a positive image appearing therein is peeled off after completion of self-processing.

There is a film unit in which an image-recording sheet with a positive image formed therein is peeled off a self-processing film unit (hereinafter simply referred to as the "film unit"), so that it can be attached to a photo album, etc. There are two known types of this film unit. One type is a peel-apart type which has heretofore been widely used, and the other type is a peelable monosheet type. The first-mentioned peel-apart type film unit, as described in detail for example in Japanese Unexam. Patent Publ. No. Sho 61-48839, is characterized in that after an image is recorded in a photosensitive sheet, the photosensitive sheet is superimposed on an image-receiving sheet, then processing solution is spread between the photosensitive sheet and the image-receiving sheet, and after a predetermined processing time has passed, the image-receiving sheet with a positive image formed therein is peeled off as an image recording sheet. On the other hand, the second-mentioned peelable monosheet type film unit, as described for example in U.S. patent application Ser. No. 07/269,016 filed Nov. 9, 1988, comprises a photosensitive sheet formed of a single base sheet, an image-receiving layer coated on the base sheet, a peelable interlayer coated on the image-receiving layer and a photosensitive layer coated on the peelable interlayer, a processing solution container, a mask sheet, and a cover sheet all integrally formed into a single assembly. After processing, an image recording sheet integrally formed of the image-receiving layer and the base sheet is peeled off from the peelable interlayer.

However, in the peel-apart type, when the image-receiving sheet is peeled off, colored processing solution sticks to the photosensitive sheet. This processing solution has a certain viscosity. If it sticks to the user's hands, clothes, etc., it can dirty them. Moreover, as it is alkaline, it can damage clothing, etc. which it contacts. Therefore, the user is required to handle the film unit carefully after the image-receiving sheet is peeled off. Also, some users are disconcerted by the color of the processing solution.

On the other hand, in the peelable monosheet type, the lower surface of the peelable interlayer serves as the peelable surface. This peelable surface has viscosity. Besides, a blue photosensitive layer can be seen through the peelable interlayer. Therefore, this type again has the same problems as the peel-apart type.

OBJECTS OF THE INVENTION

A principal object of the present invention is to provide a film unit which is easy to handle after an image recording sheet is peeled off.

Another object of the invention is to provide a film unit in which a peeled surface thereof is improved so as not to feel disagreeable to the user.

A further object of the invention is to provide a film unit in which processing solution remaining on the peeled off surface thereof is prevented from sticking to clothing, etc.

SUMMARY OF THE INVENTION

In order to achieve the above and other objects and features, a film unit of the present invention has an over sheet one side of which is bonded to a front end of the film unit and which is adapted to cover a surface from which an image recording sheet has been removed.

According to the present invention, as the over sheet is attached to the film unit in such a manner as to cover the surface of the film unit that has been exposed by peeling, this exposed surface of the film unit will not feel disagreeable to the user, and the hands, clothes, etc. are prevented from being soiled with processing solution. Therefore, it is easy to handle the film unit after peeling off the image recording sheet.

BRIEF DESCRIPTION OF THE DRAWINGS

These and other objects and features of the present invention will become more apparent from the detailed description to follow with reference to the drawings, in which.

DETAILED DESCRIPTION OF THE INVENTION

Figure 1:
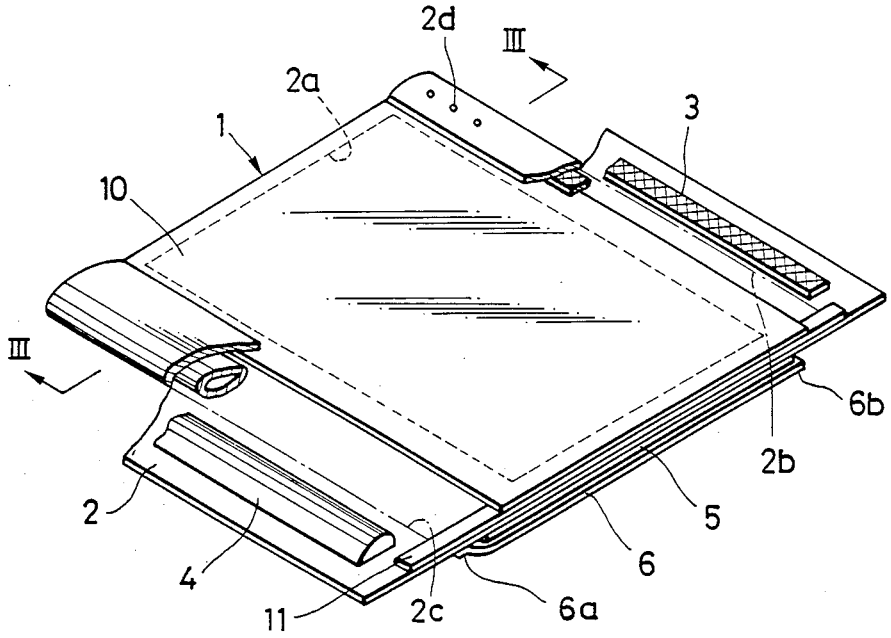
FIG. 1 is a perspective view, partly opened out, of a peelable monosheet-type film unit incorporating the present invention.

In FIG. 1 showing a first embodiment of a peelable monosheet-type film unit 1 of the present invention, a mask sheet 2 is formed of a comparatively thin plastic film sheet. The mask sheet 2 has an opening 2*a* defining an image-forming area formed generally in its center, and folding lines 2*b* and 2*c* formed in each of the front and rear ends thereof. The mask sheet 2 also has a trapping member 3 adapted to catch a surplus processing solution and a processing solution container 4 adapted to contain a processing solution, the member 3 and the container 4 being bonded to end portions of sheet 2 beyond the folding lines 2*b* and 2*c*. The mask sheet 2 is further provided with a plurality of tiny air holes 2*d* formed in a portion where the trapping member 3 is bonded and adapted to discharge air during processing.

Figure 2:
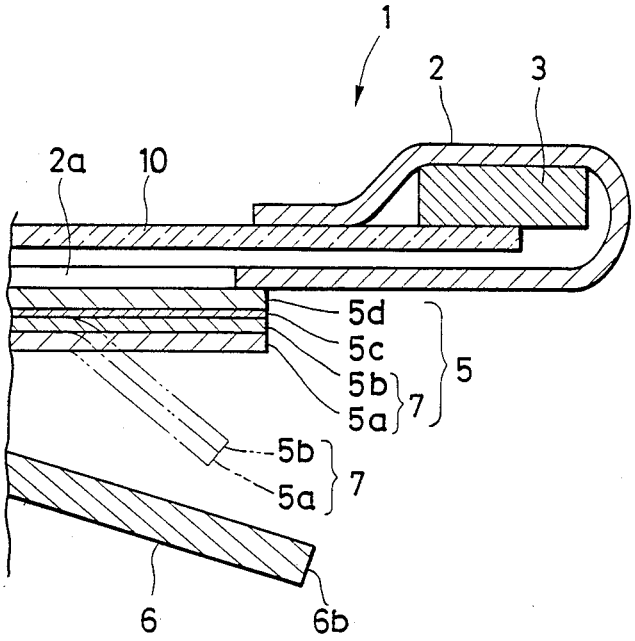
FIG. 2 is an enlarged fragmentary cross-section view showing a rear end portion of the film unit.

A photosensitive sheet 5 heat sealed to the lower surface of the mask sheet 2 has a size at least equal to that of the opening 2*a* defining the image-forming area. The photosensitive sheet 5, as shown in FIG. 2, comprises a base sheet 5*a* made of a waterproof paper sheet (WP), a polyethylene terephthalate sheet (PET) or the like, an image-receiving layer 5*b* coated on the base sheet 5*a*, a peelable interlayer 5*c* coated on the image-receiving layer 5*b*, and a photosensitive emulsion layer 5*d* coated on the peelable interlayer 5*c*. The photosensitive emulsion layer 5*d* of the photosensitive sheet 5 is heat sealed to the lower surface of the mask sheet 2 through an adhesive agent.

An over sheet 6 is disposed on outer side of the photosensitive sheet 5 with its front end 6*a* bonded to a front end portion of the mask sheet 2. This over sheet 6 is longer than the photosensitive sheet 5 and adapted to cover, through the peelable interlayer 5c, the entirety of the photosensitive emulsion layer 5d which remains after a photo print 7 composed of the base sheet 5a and the image-receiving layer 5d has been peeled off the peelable interlayer 5c. As a material for this over sheet 6, a material which has been made opaque by coloring or printing is used.

Figure 3:
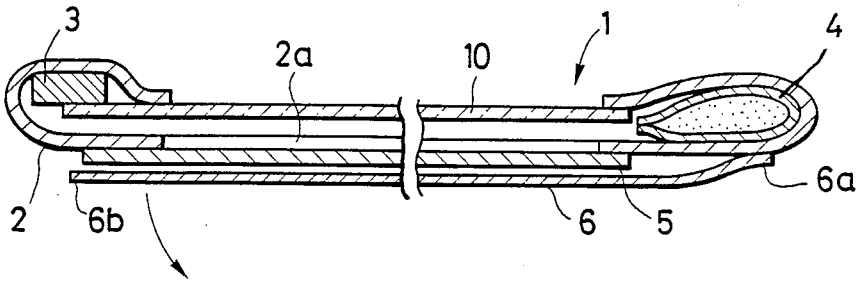
FIG. 3 is a sectional view taken on line III—III of FIG. 1 and showing a first embodiment of the present invention.

A cover sheet 10 is made of a transparent comparatively thick plastic sheet. Light coming from the object passes through this cover sheet 10 and falls on the photosensitive emulsion layer 5d. The side portions of the cover sheet 10 and the mask sheet 2 are heat sealed together through spacer rail members 11. These spacer rail members 11 serve to confine the processing solution to a uniform width. Also, as is apparent from FIG. 3, the mask sheet 2 is folded back at the folding lines 2b and 2c, and the front end and the rear end of the mask sheet 2 are adhered to the cover sheet 10. By this folding back, the trapping member 3 and the processing solution container 4 are enclosed by the mask sheet 2, respectively. Several film units 1, as is well known, are stacked one upon another and stored in a film pack having an opening for exposing the film units and another opening for discharging them. Then, the film pack is loaded in an instant camera.

The over sheet 6 is required to be thin and have a restoring property (it is naturally superposed on a unit surface when the over sheet 6 is left as it is), to have a reduced resistance at its surface which contacts the processing rollers when the processing solution is being spread, and to have a tendency to cling to the peeled surface of the film unit. Examples of such materials as have a certain degree of restoring force are plastic film, synthetic paper, paper, nonwoven fabric, coated or cemented film. Among them, plastic film is particularly preferred because it can easily satisfy the above-mentioned three conditions.

Examples of such plastic film are polyolefin film, polyester film, nylon film, polyvinylalcohol film, vinyl chloride film, vinylidene chloride film, polystyrene film, vinylon film, polycarbonate film, polysulfone film, polymethylpentene film, polybutyne film, cellulose film, and acrylonitrile film. The properties of these films are described in a printed publication entitled "Plastic Film Resin Material General Survey '87", edited by Kako Gijutsu Kenkyukai and issued in 1987, and a printed publication entitled "Package Film Sample Collection" prepared by Kabushiki Kaisha Nippo in 1987.

Furthermore, as dimensional accuracy is required for manufacturing a film unit, materials having a large elasticity are not desirable. For this reason, among the plastic films, a polyester film is particularly preferable as a material satisfying this feature. Furthermore, the film preferably has a thickness in the range from about 15 to 50 μm in order to satisfy the requirement of having a suitable restoring property.

In order to reduce resistance with the rollers when spreading the processing solutions, lubricant is applied to the surface or unevenness is formed on the surface. As examples of the lubricant, there can be listed paraffin wax, higher fatty acids, fatty acid amides, fatty acid alcohol esters, metal soaps, fluorocarbons, silicone-type polymers, aliphatic alcohols, and their mixtures. The properties of these lubricants are described in a printed publication entitled "Revised and Enlarged Edition of Useful General Survey of Additives for Plastic and Rubber", pps. 945–949, issued by Kagaku Kogyo Sha in 1987 and a printed publication entitled "Viscous Handbook", pps. 61–63, edited by Nippon Viscous Tape Kogyo Kai, issued in 1985.

In order to form unevenness on the surface of the over sheet 6, the over sheet is given an embossed finish or an agent producing a mat finish is added to the raw material of the over sheet 6. If a lubricant layer is provided on each surface of the over sheet 6 and an adhesion layer is formed on the lubricant layer of one surface of the over sheet 6 in order to augment the tendency to adhere to the peeled surface of the film unit 1, the lubricant will migrate to the outer surface of the adhesion layer with the passage of time. As a result, there will be poor adhesion between the adhesion layer and the peeled surface of the film unit 1. On the contrary, in case an adhesion layer is formed on a single surface of the over sheet 6 and then a lubricant layer is formed on the other surface thereof, the lubricant layer, which is in a roll, is in contact with the adhesion layer. The lubricant is thus transferred to the outer surface of the adhesion layer. As a result, the function of the adhesion layer is impaired. These problems can be reduced by means of selective employment of a lubricant selected from among many lubricants, taking into consideration the properties thereof. However, the method for forming unevenness on the surface of the over sheet 6 is not accompanied with this problem of transfer of a lubricant and therefore is considered to be superior to the method that involves forming a lubricant layer on the over sheet 6.

In order to promote the tendency of the over sheet 6 to adhere to the peeled surface of the film unit 1, it is effective to apply a hydrophilic polymer to a surface of the over sheet 6 which contacts the peeled surface of the photosensitive material. The hydrophilic polymer thus employed can be gelatin, polyvinyl alcohol, or acrylic acid. Among these, gelatin is preferred because it has a large selectable range of physical properties (viscosity, polarity, solubility and compatibility). Among the available gelatins, a demineralized gelatin from which calcium ions have been removed is particularly preferable because it has good liquid stability in a mixed solvent of water and alcohol and a low dry load can be achieved.

Taking into consideration the foregoing, the present inventions have found through experimentation that, preferably, a mat PET X-44 type #26 (trade name, manufactured by Toray Industries, Inc., Japan) can be used which as suitable restoring property, a slip property on its single surface and a thickness of 26 μm, and a gelatin solution is coated (1 $g/m^2$ solid content) on the other surface of the slip surface.

Next, the function of the film unit will be described. The film unit 1 is first loaded into an instant camera. When taking a picture, light coming from the object falls on the photosensitive emulsion layer 5d after passing through the cover sheet 10. After taking the picture, the leading edge of the film unit 1 is grasped between a pair of processing rollers built into the instant camera and passes therebetween under pressure. At the beginning of the operation of the spreading rollers under pressure, the processing solution container 4 is ruptured by the rollers and the processing solution stored in the container 4 is spread into the gap between the cover sheet 10 and the photosensitive layer 5d of the photosensitive sheet 5. Surplus processing solution flows into the trapping member 3 from a space between one end of the cover sheet 10 and the mask sheet 2 and is trapped therein.

After passing through the processing rollers, the film unit 1 is discharged from the instant camera. At this time, since the front side 6a of the over sheet 6 is attached to the lower surface of the mask sheet 2 on the front end side of the film unit 1 and the outer surface thereof has an uneven finish in order to provide a reduced frictional resistance, the over sheet 6 is not peeled off by the spreading rollers and discharged in a condition wherein the over sheet 6 is superposed on the film unit 1.

The film unit 1 is processed by the processing solution spread on the photosensitive sheet 5 across a predetermined width. By this processing, the latent image formed in the photosensitive emulsion layer 5d is transferred to the image-receiving layer 5b as a positive image through the peelable interlayer 5c.

When the rear side 6b of the over sheet 6 is opened and the exposed base sheet 5a is pinched by the fingers of the user to open after a predetermined processing time has passed, a photo print 7 composed of the image-receiving layer 5b with a positive image of the object appeared thereon and the base sheet 5a is peeled off from the peelable interlayer 5c. Furthermore, as the photosensitive emulsion layer 5d is firmly sealed to the mask sheet 2, the photosensitive emulsion layer 5d and the peelable interlayer 5c remain on the mask sheet 2.

Although the peelable interlayer 5c is tacky, the over sheet 6 is returned to its original position immediately after the photo print 7 is peeled off, thanks to its restoring property, and intimately adheres to the peelable interlayer 5c to cover the same. Thus the peelable interlayer 5c does not adhere to anything else. Moreover, the blue photosensitive emulsion layer 5d, which can be seen through the peelable interlayer 5c, is hidden. After peeling off, therefore, the film unit 1 can be temporarily put into the user's pocket or it can be discarded.

Figure 4:
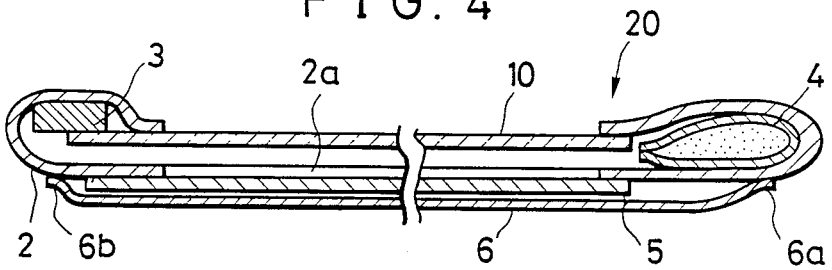
FIG. 4 is a side sectional view similar to FIG. 1 of a second embodiment of the present invention.

FIG. 4 shows another embodiment of the present invention. In this embodiment, the over sheet 6 is adhered to the mask sheet 2 not only at the front side 6a but also at the rear side 6b. In this way, the film unit 1 and the over sheet 6 can be integrally formed and handling becomes easy in the manufacturing process. The adhesion of the rear side 6b is weak so that the user can peel it off with ease. This weak adhesion can be achieved by means of linear adhesion having a narrow width or by applying an adhesive agent only to spots.

Figure 5:
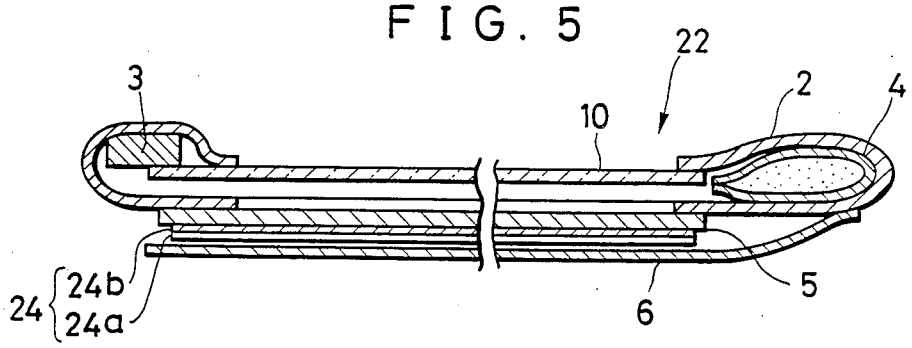
FIG. 5 is a side sectional view similar to FIGS. 1 and 2 of a third embodiment of the present invention.

FIG. 5 shows a third embodiment of the present invention. The film unit 22 has an adhesive sheet 24 consisting of an adhesive member 24b and a releasing sheet 24a, disposed on the upper surface of the photosensitive sheet 5, and the over sheet 6 is disposed on the lower surface thereof. In this embodiment, when the releasing sheet 24a is peeled off after the photo print has been peeled off, the adhesive member 24b is exposed and the photo print can be attached to a photo album, etc. as it is. In this embodiment, the over sheet 6 functions in the same way as in the above-mentioned embodiments.

Figure 6:
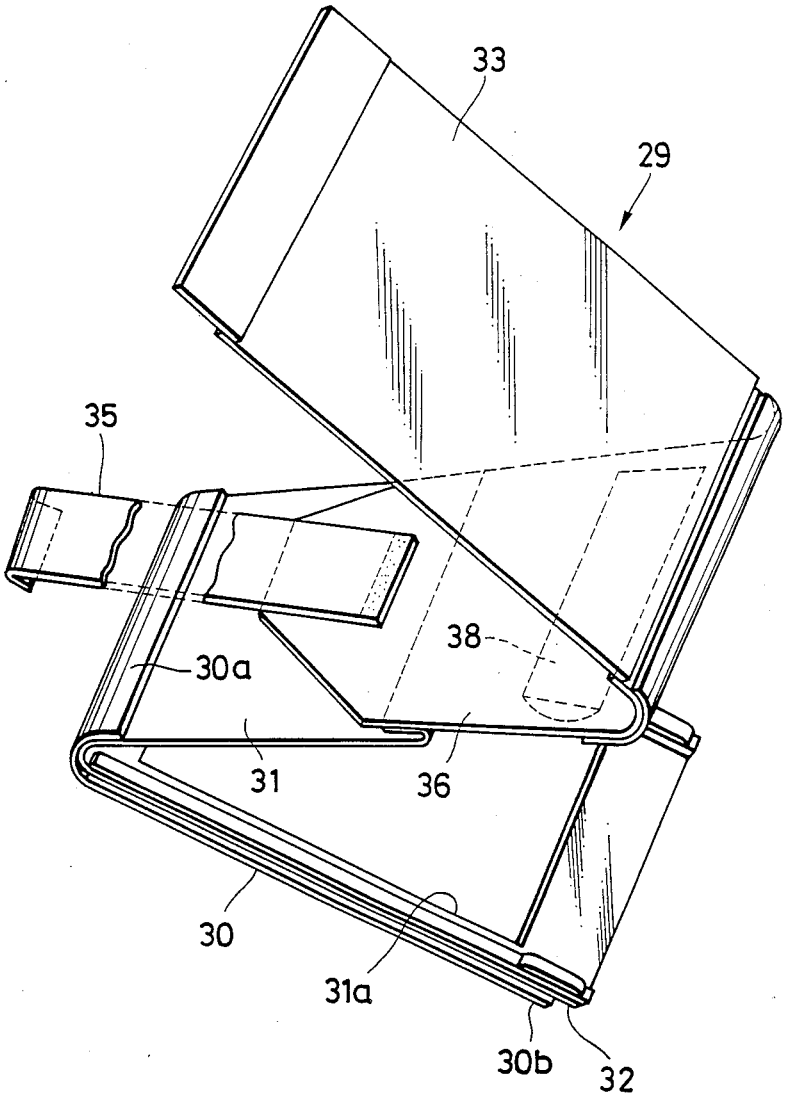
FIG. 6 is a perspective view of a peel-apart type film unit incorporating the present invention.

FIG. 6 shows still another embodiment in which the present invention is applied to a peel-apart type film unit. The front side 30a of the over sheet 30 is bonded to a mask sheet 31 having an opening 31a for defining an image forming area and superimposed in such a manner as to cover the entirety of an image-receiving sheet 32. When a tab 35 is pulled out by hand from a film pack (not shown) containing a film unit 29 after exposure of a photosensitive sheet 33, a pull sheet 36 is pulled out together with the tab 35. At this time, the mask sheet 31 is moved toward the exit of the film pack while being superimposed on the pull sheet 36 from its front end which is progressively inverted.

At the time the pull sheet 36 passes between a pair of processing rollers, a processing solution container 38 is ruptured. Processing solution flowing out of this container 38 is spread by the processing rollers to a uniform width between the image-receiving sheet 32 and the photosensitive sheet 33. By this processing solution, an image recorded in the photosensitive sheet 33 is transferred to the image-receiving sheet 32 as a positive image. When only the image-receiving sheet 32 is peeled off the film unit 29 after passage of a predetermined time for processing, an instant photo can be obtained. When this image-receiving sheet 32 is peeled off, the processing solution in the opening 31 is exposed. The over sheet 30 is superimposed by its own restoring force on the mask sheet 31 from which the image-receiving sheet 32 has been peeled off, and the over sheet 31 adheres to the processing solution in the opening 31a. As a result, since the over sheet 30 covers at least the opening 31a through the mask sheet 31, the processing solution does not contact the user's hand, etc. Therefore, the film unit 29 can be thrown away as it is. The rear side 30b of the over sheet 30 may be weakly adhered to the mask sheet 31 as in the embodiment of FIG. 2.

It is convenient to print handling instructions and illustrations of the film unit on the back of the over sheet.

The invention has been described with reference to several preferred embodiments. However, it will be appreciated that variations and modifications can be effected by those of ordinary skill in the art without departing from the scope of the invention.

What is claimed is:

1. A self-processing film unit in which an image recording sheet with a positive image formed therein is peeled off after processing, and an over sheet secured to said unit for covering a surface from which said image recording sheet has been peeled off.

2. A self-processing film unit as claimed in claim 1, wherein one side of said over sheet is adhered to a front end of said film unit where a processing solution container is located.

3. A self-processing film unit as claimed in claim 2, wherein a side of said over sheet opposite to said one side is adhered to a rear end of said film unit.

4. A self-processing film unit as claimed in claim 1, wherein said over sheet is a plastic sheet.

5. A self-processing film unit as claimed in claim 4, wherein said plastic sheet is a polyester sheet.

6. A self-processing film unit as claimed in claim 5, wherein said over sheet is 15 to 50 $\mu$m in thickness.

7. A self-processing film unit as claimed in claim 1, wherein said over sheet has a hydrophilic polymer layer formed on a surface thereof which contacts said surface.

8. A self-processing film unit as claimed in claim 7, wherein said over sheet has a lubricant layer on a surface opposite to said surface.

9. A peelable monosheet self-processing film unit comprising:

a light transmissive cover sheet;

a mask sheet attached to a lower surface of said cover sheet with a predetermined space between said cover sheet and said mask sheet, said mask sheet having a framing opening smaller than said cover sheet for defining an image forming area, said mask sheet being bonded at an end portion thereof to an upper surface of said cover sheet, a processing solution container and a trapping member enclosed respectively in front and rear ends of said mask sheet;

a photosensitive sheet attached to a lower surface of said mask sheet in such a manner as to block said framing opening of said mask sheet, said photosensitive sheet having a base sheet, an image-receiving layer for recording a positive image thereon being coated on said base sheet, a peelable interlayer adapted to permit peeling off said image-receiving layer together with said base sheet, a photosensitive emulsion layer sensitive to incident light coated on said peelable interlayer, said photosensitive emulsion layer being adjacent said mask sheet; and an over sheet for covering said peelable interlayer after said image-receiving layer and said base sheet have been peeled off from said peelable interlayer, a front side of said over sheet being adhered to a lower surface of said mask sheet adjacent said processing solution container.

10. A peelable monosheet self-processing film unit as claimed in claim 9, wherein said over sheet is a plastic sheet.

11. A peelable monosheet self-processing film unit as claimed in claim 10, wherein said plastic sheet is opaque.

12. A peelable monosheet self-processing film unit as claimed in claim 9, further including an adhesive sheet having a releasing sheet which is attached to an outer surface of said base sheet.

13. In a peel-apart self-processing film unit having a mask sheet formed with a framing opening for defining an image forming area, an image-receiving sheet attached to said mask sheet in such a manner as to block said framing opening and adapted to be peeled off said mask sheet after passage of a predetermined time for processing, a photosensitive sheet which is to be superimposed on said image-receiving sheet through said mask sheet after exposure of said photosensitive sheet, and a container of processing solution which is to be spread between said superimposed photosensitive sheet and said image-receiving sheet; the improvement comprising:

an over sheet for covering said framing opening exposed by means of peeling-off of said image-receiving sheet, a front end of said over sheet being secured to a lower surface of said mask sheet.

14. A peel-apart self-processing film unit as claimed in claim 13, wherein said over sheet is a plastic sheet.

15. A peel-apart self-processing film unit as claimed in claim 14, wherein said plastic sheet is opaque.

* * * * *